US005298693A

United States Patent [19]

Heijn

[11] Patent Number: 5,298,693

[45] Date of Patent: Mar. 29, 1994

[54] SPEAKER SUPPORT STAND

[76] Inventor: Roland A. Heijn, R.D. 2, Box 717, Woodstock, Vt. 05091

[21] Appl. No.: 896,994

[22] Filed: Jun. 11, 1992

[51] Int. Cl.[5] ..... A47B 81/06

[52] U.S. Cl. ..... 181/199; 181/207

[58] Field of Search ..... 181/148, 150, 198, 199, 181/207, 208, 209; 381/90, 205; 248/638

[56] References Cited

U.S. PATENT DOCUMENTS

| | | | |
|---|---|---|---|
| 1,837,755 | 12/1931 | Carlisle et al. | 181/148 |
| 2,973,824 | 3/1961 | Pinski | 181/144 |
| 3,779,337 | 12/1973 | Gregory | 181/151 |
| 4,284,167 | 8/1981 | Kozlow et al. | 181/172 |
| 4,408,678 | 10/1983 | White, Jr. | 181/199 |
| 4,591,020 | 5/1986 | Hruby, Jr. | 181/145 |
| 4,618,025 | 10/1986 | Sherman | 181/148 |
| 4,623,034 | 11/1986 | Saito et al. | 181/148 |
| 4,730,693 | 3/1988 | Kobus | 181/199 X |
| 4,778,027 | 10/1988 | Taylor | 181/175 |
| 4,869,340 | 9/1989 | Coudoux | 181/146 |

*Primary Examiner*—Michael L. Gellner
*Assistant Examiner*—Khanh Dang

[57] ABSTRACT

A vibration damping support stand for a loud speaker enclosure system wherein the enclosure defines bottom and top and opposite side walls. A framework includes a pair of oppositely-facing upstanding parallel standards movable toward and away from each other. A horizontally-extending inwardly-facing support arm projects inwardly from each standard toward the other arm for jointly supporting a base upon which the bottom wall of the enclosure may be seated. A side pad is mounted on the inboard face of each standard for embracing a respective enclosure side wall. An upper pad is adapted for bearing upon the enclosure top wall. Resilient tensioners are strategically located between each standard and the upper pad and between each standard and the base. The arrangement accomplishes reducing and draining off of any enclosure vibrations and allows speaker performance which is relatively free of confusing spurious resonances.

10 Claims, 7 Drawing Sheets

SPEAKER SUPPORT STAND

BACKGROUND OF THE INVENTION

1. Field of the Invention

The invention relates to stands or supports for cabinet type loud speakers as used in high quality home music or sound systems, or high fidelity systems.

2. Description of the Prior Art

Most loud speakers of the home variety are of the cabinet type and are of medium quality which offer generally reasonable sound except for tending towards boominess, or exaggerated bass tones.

One of the factors involved in proper reproduction of sound, especially the lower or bass tones, is the reaction or interaction of the speaker cabinet itself. The more the cabinet vibrates, the poorer the sound. There are speaker stands on the market which claim to help this by forming a solid base on which the cabinet sits, and helping to drain vibrations into the floor on which the stand sits. But this is not the cure-all.

Simply raising speakers off the floor helps to reduce "boominess" or distortion of the lower musical tones. This is generally known; and there are stands available, as "extras" by some manufacturers for their own speakers, and from accessory companies for more or less universal application.

All of the stands of which I am aware have been simple pedestals of varying construction consisting of pillars or frameworks of wood or metal construction upon which the cabinet sits. Sometimes screws or bolts hold the cabinet bottom firmly to the stand top, with the intent of transferring some cabinet vibration through the stand into the floor of the room. None of these designs attempt to deal with more than the vibration of the bottom of the cabinet.

The prior art stands have been largely ineffective in controlling speaker cabinet vibrations or improving the speaker bass tone quality.

SUMMARY OF THE INVENTION

The term "speaker" as used herefollowing will be understood to refer to the complete assembly of enclosure or cabinet, with drivers, wiring and the like contained therein, the drivers being the devices which convert electrical impulses into audible sound, the larger ones called woofers, the smaller ones called tweeters, and those in between called mid-range.

The speaker support stand of the invention includes a pair of upright standards movable toward and away from each other for accommodation to the speaker cabinet geometry and each having an arm which cooperantly with the opposing arm offers a seating for a base upon which the speaker will sit.

Also included are a pair of side blocks or pads (one for each standard) which may be mated, each with a standard, so as to embrace the respective sides of the speaker in an osculating manner.

Resilient tensioning means are strategically placed between the standards above the top of the speaker and below the base upon which the speaker sits.

By the resilient tensioning means, the speaker is held firmly and virtually tremorless relative to the stand wherefore vibratory effects are minimized, certain thereof being drained through the stand to the flooring.

An uppermost block or pad rests on the speaker and is embraced in tensioned position between the standards.

The speaker support stand hereof improves bass tone quality by clasping or clamping the speaker from the sides and top to exert a downward and side pressure against the speaker thereby restraining speaker vibration, and transfering vibration away from the speaker and into the floor.

The speaker support stand of the invention forms a framework and support for and clasps the speaker top, sides and bottom.

Resilient tensioning means cooperate with blocks or pads placed between the framework and the cabinet top and sides to hold the speaker firmly against a support platform and to exert an inward pressure against the sides of the speaker, thereby dampening and reducing speaker vibrations and channeling any remaining vibrations through the stand to the floor.

The support stands are of simple design and are preferably formed of solid maple or other native hardwood such as ash, oak or beech. Several configurations are possible and other materials may be employed including cast reinforced concrete which may be poured into and remain in a finished mold, or be coated later with a smooth protective surface. (Audiophiles tend to be perfectionists and some will go to almost any means to achieve more perfect sound reproduction.) Concrete would "ring" less than wood and, especially, metal; and be less likely to vibrate in use. Metal stands can be filled with sand or some other vibration-damping medium.

DESCRIPTION OF THE PREFERRED EMBODIMENTS

THE EMBODIMENT OF FIGS. 1–5

Figure 1:
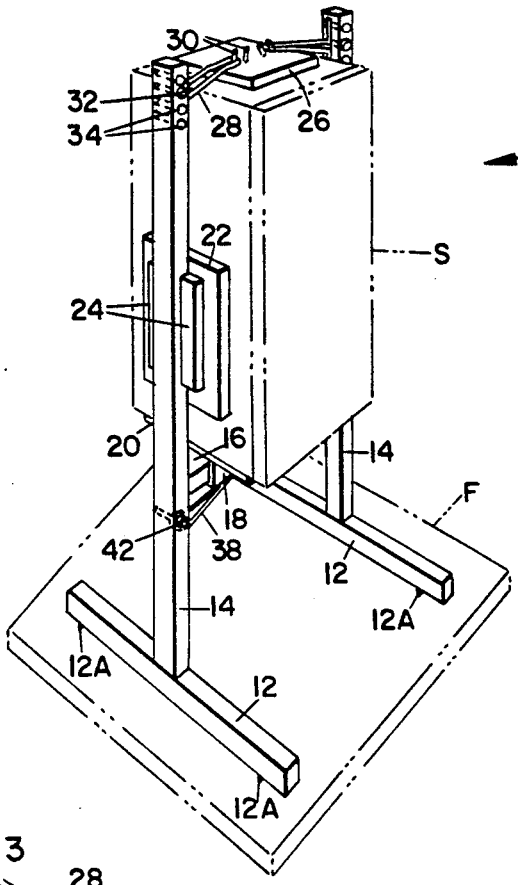
FIG. 1 is a front perspective view of a speaker support stand embodying a preferred form of the invention, a speaker being shown in phantom.
Figure 2:
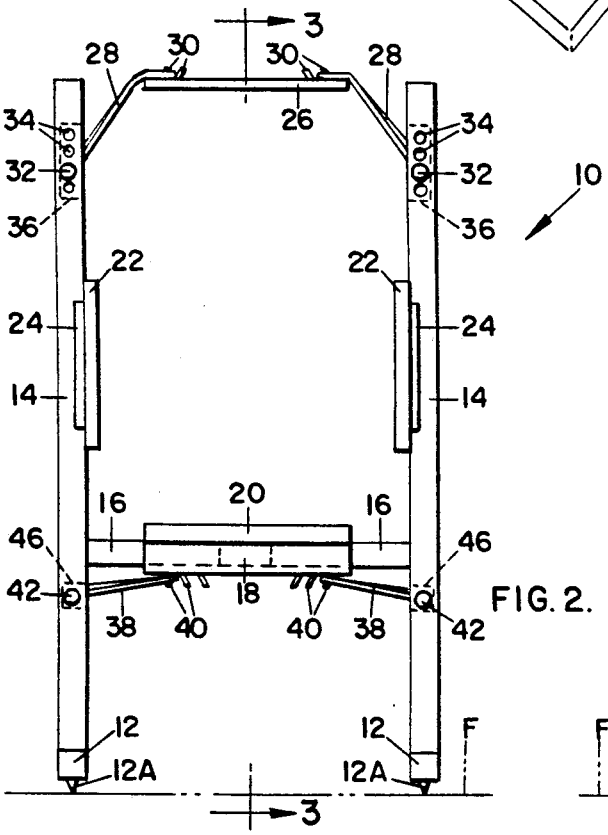
FIG. 2 is a front elevational view of the speaker support stand of FIG. 1.

Referring first to FIGS. 1–5, a speaker support stand 10 embodying a preferred form of the invention resiliently supports a cabinet-type loud speaker S, shown in phantom, above the floor F or other surface.

Speaker support stand 10 includes a pair of elongated, generally rectangular, horizontally-disposed legs 12 having small, pointed depending feet 12A adjacent each end thereof which support the legs upwardly of floor F. Legs 12 are disposed in spaced parallelism to each other.

A pair of elongated generally rectangular upright standards or posts 14 are fixed at their lower ends to legs 12 centrally of the latter, and are also disposed in spaced parallelism to each other.

Legs 12 and standards 14 are preferably fabricated from solid maple or other native hardwood, such as ash, oak or beech, although other materials may be used.

Feet 12A may be fabricated from wood or metal.

A pair of generally rectangular horizontally-disposed axially-aligned, inwardly-extending support arms 16 are each fixed at one end to the inner face of a standard 14 upwardly of legs 12.

The opposite, facing free ends of support arms 16 are sleeved by a U-shaped slide member 18 which has a horizontally-disposed rectangular speaker support platform 20 fixed centrally to its upper face.

Arms 16 are slidable relative to slide member 18 and support platform 20 so that the spacing between standards 14 may be varied as desired to accommodate speaker cabinets of various dimensions placed on support platform 20.

A generally rectangular side block or pad 22 is provided on the inner face of each standard 14 upwardly of support platform 20, each side block 22 having a pair of spaced, parallel vertically disposed rails 24 fixed to its rear face and lightly engageable with the side walls of the adjacent standard 14, permitting the side blocks to be fixed in position at any desired height above the floor, while also permitting sliding movement of side blocks 22 relative to standards 14.

Side blocks 22 provide side support for speaker S, as shown in FIG. 1.

A generally rectangular top plate or pad 26 is positioned centrally between standards 14 upwardly of side blocks 22 and rests on the top wall of the speaker cabinet.

Top plate 26 is supported relative to standards 14 by resilent tensioning means 28 in the nature of elastic bands or springs which extend between upright pins 30 provided on the upper face of the top plate and an anchor pin 32 provided adjacent the upper end of each standard 14.

Anchor pins 32 are slidably receivable in any one of a series of vertically spaced openings 34 which extend horizontally through each standard 14.

The interior of each standard 14 is hollowed out in the area of openings 34 to provide a vertically-disposed slot 36 which extends inwardly into the standard to permit access to the shank of anchor pin 32 so that an end of resilient tensioning means 28 can be secured thereto.

In FIGS. 1–5, resilient tensioning means 28 comprise a pair of endless elastic bands, each secured at one end to one of the pins 30 and at its opposite end to one of the anchor pins 32.

Platform 20 is similarly supported relative to standards 14 by resilient tensioning means 38 in the nature of endless elastic bands or springs extending between pins 40 which depend from slide member 18 and an anchor pin 42 provided adjacent support arm 16 in each standard 14.

Anchor pin 42 is slidably receivable in an opening 44 which extends horizontally through each standard 14.

The interior of each standard 14 is hollowed out in the area of opening 44 to provide a vertically inwardly-extending slot 46 which permits access to the shank of anchor pin 42 so that an end of resilient tensioning means 38 can be secured thereto.

In FIGS. 1–5, resilient tensioning means 38 comprises a pair of endless elastic bands, each secured at one end to one of the pins 40 and at its opposite end to one of the anchor pins 42.

Figure 3:
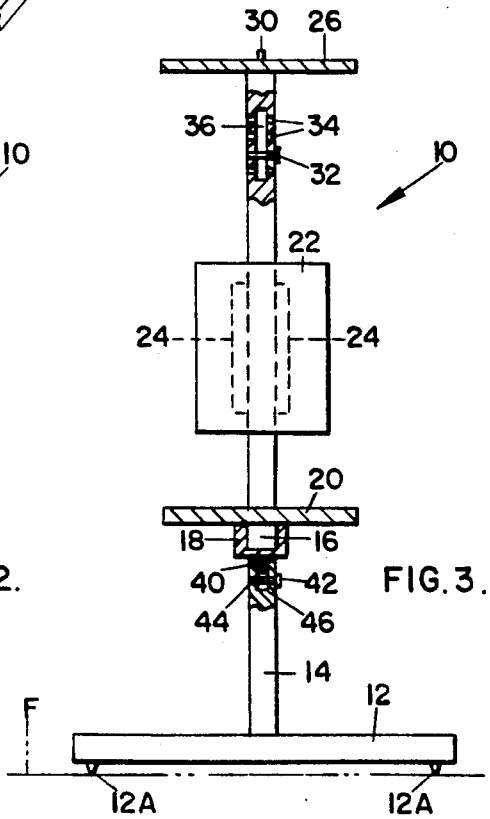
FIG. 3 is a cross sectional view taken on line 3—3 of FIG. 2, with parts omitted for clarity.
Figure 4:
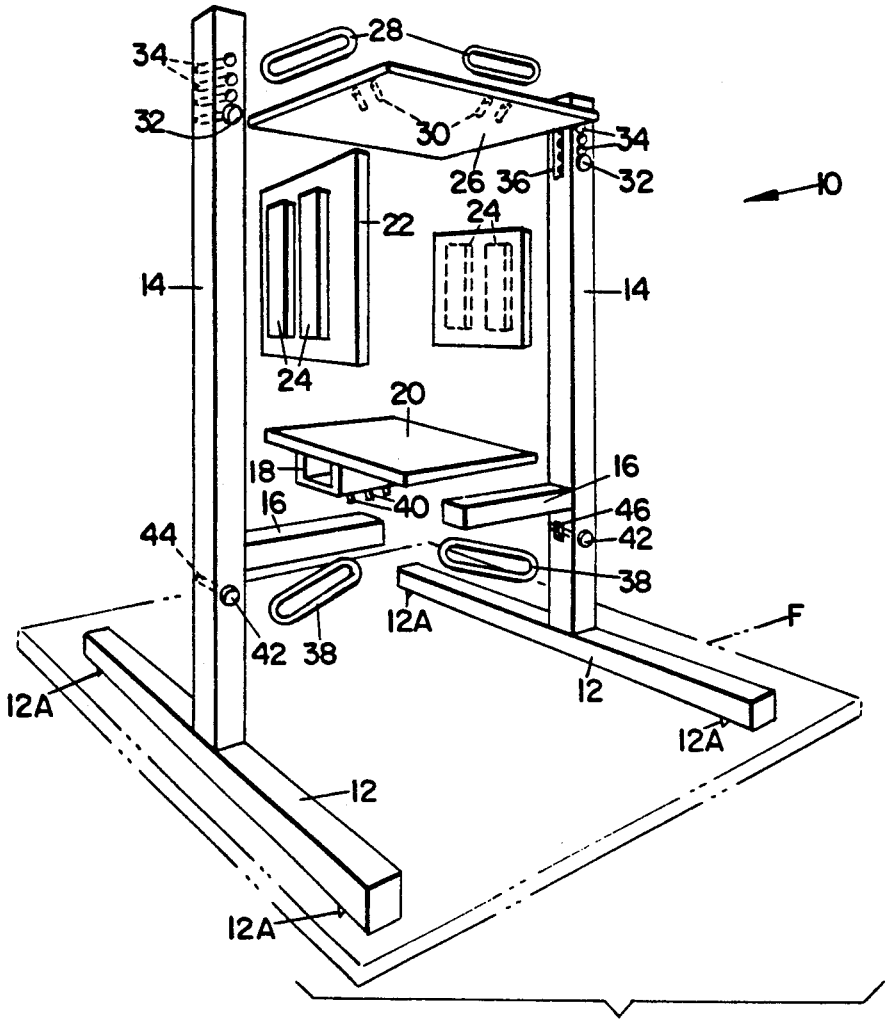
FIG. 4 is an exploded front perspective view of the speaker support stand of FIG. 1.
Figure 5:
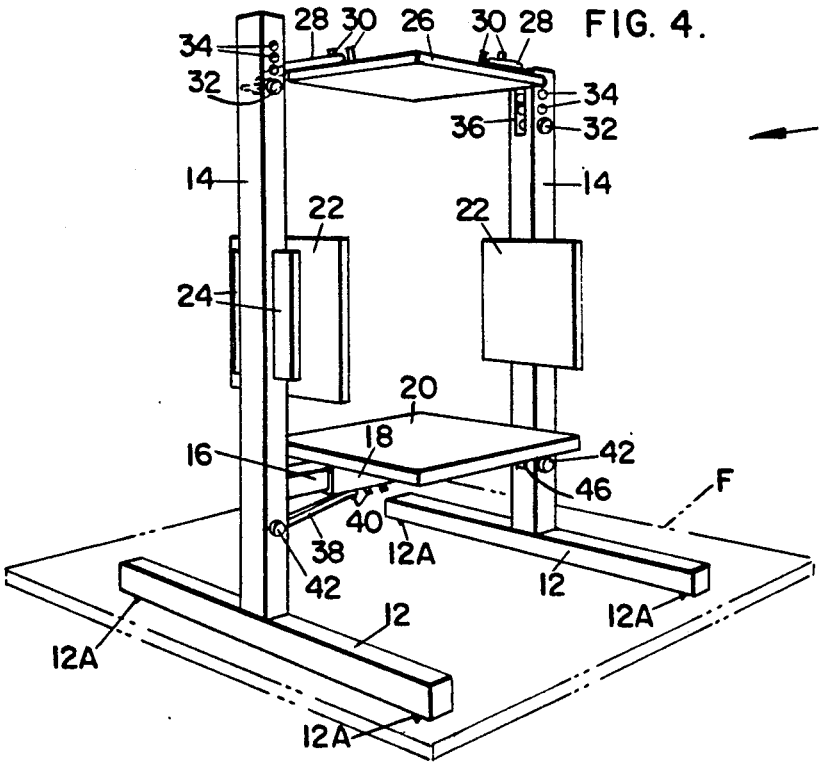
FIG. 5 is a front perspective view of the speaker support stand of FIG. 1.
Figure 6:
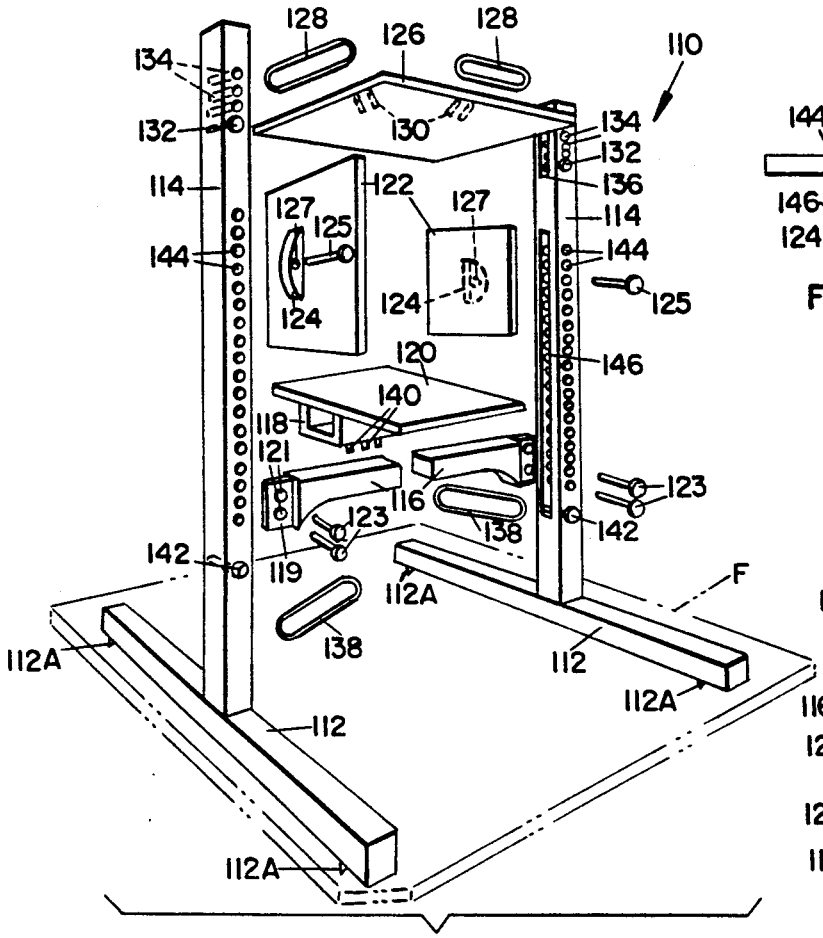
FIG. 6 is an exploded front perspective view of a first modified form of speaker support stand embodying the invention.
Figure 10A:
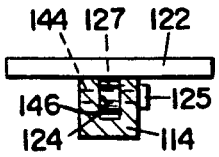
FIG. 10A is an enlarged, fragmentary, part-sectional top plan view of one of the side blocks or pads and posts of the speaker support stand of FIGS. 6 and 7.
Figure 10:
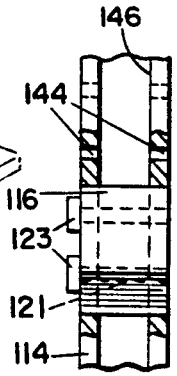
FIGS. 8–10 are enlarged, fragmentary front elevational, top plan and end elevational views respectively of one of the support arms and posts of the speaker support stand of FIGS. 6 and 7.
Figure 7:
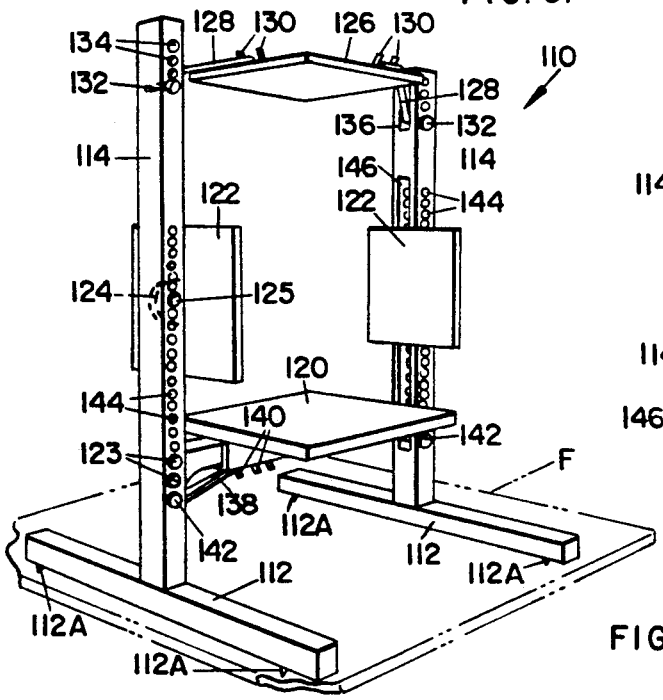
FIG. 7 is a front perspective view of the speaker support stand of FIG. 6.
Figure 8:
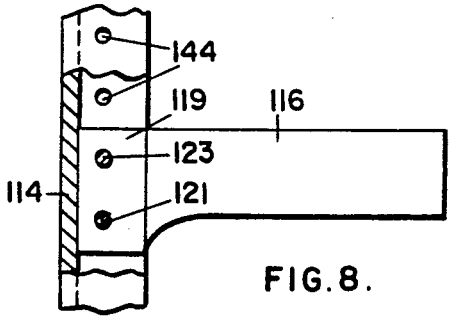
Figure 9:
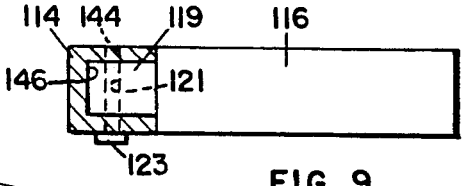

Resilient tensioning means 28 and 38 have been omitted from FIG. 3 for clarity.

By the interaction of the standards 14, side blocks or pads 22, top plate or pad 26 and support plateform 20, and the strategic placement of the resilient tensioning means 28 and 38 between the standards above the top of the speaker and below the platform upon which the speaker sits, the speaker is held firmly and virtually tremorless relative to the stand wherefore vibratory effects are minimized, with certain thereof being drained through the stand to the floor.

THE EMBODIMENT OF FIGS. 6–10

A first modified speaker support stand 110 is shown in FIGS. 6–10.

Speaker support stand 110 is similar to speaker support stand 10 and includes a pair of elongated, generally rectangular, horizontally-disposed legs 112 having small, pointed depending feet 112A which rest on floor F. Legs 112 are disposed in spaced parallelism to each other.

A pair of elongated generally rectangular upright standards or posts 114 are fixed at their lower ends to legs 12 centrally of the latter and are also disposed in spaced parallelism to each other.

Support stand 110 differs from support stand 10 in that a pair of axially aligned, horizontally disposed support arms 116 are removably attached to standards or posts 114 so as to be vertically repositionable relative to the standards to accommodate speakers of various sizes.

Arms 116 each include an integral, vertically-disposed, rectangular boss 119 which extends outwardly from one end thereof and is receivable in a vertically-disposed slot 146 of complemental width which extends inwardly into each standard from an adjacent face of the standard into its interior.

A series of vertically equi-spaced openings 144 extend horizontally through each standard 114 and open into slot 146.

A pair of vertically-spaced openings 121 extend horizontally through each boss 119 and are alignable with a selected pair of openings 144 in standard 114.

A pair of locking pins 123 insertible through openings 144 in standard 114 and openings 121 in each boss 119 are provided for locking arms 116 in selected positions relative to standards 114.

The opposite, facing free ends of support arms 116 are sleeved by a U-shaped slide member 118 which has a horizontally-disposed rectangular support platform 120 fixed centrally to its upper face.

As with speaker support stand 10, arms 116 are slidable relative to slide member 118 and support platform 120 so that the spacing between standards 114 may be varied as desired.

A generally rectangular side block or pad 122 is provided on the inner face of each standard 114 upwardly of support platform 120, each side block 122 having a flat, rounded vertically-disposed boss 124 fixed centrally to and extending rearwardly from its rear face.

Each boss 124 is receivable in vertically disposed slot 146 in each post 114.

A locking pin 125 insertible through opening 144 in posts 114 and an opening 127 which extends horizontally through each boss 124 for locking side blocks or pads 122 in selected positions relative to posts 114, thereby permitting the side blocks to be fixed in position at any desired height above the floor.

A generally rectangular top plate or pad 126 is positioned centrally between standards 114 upwardly of side blocks 122 and is adapted to rest on the top of a speaker, not shown.

Top plate 126 is supported relative to standards 114 by resilient tensioning means 128 in the nature of elastic bands or springs which extend between upright pins 130 provided on the upper face of the top plate and an anchor pin 132 provided adjacent the upper end of each standard 114.

Anchor pins 132 are slidably receivable in any one of a series of vertically spaced openings 134 which extend horizontally through each standard 114.

The interior of each standard 114 is hollowed out in the area of openings 134 to provide a vertically-disposed slot 136 which extends inwardly into the standard to permit access to the shank of anchor pin 132 so that an end of resilient tensioning means 128 can be secured thereto.

As with the FIGS. 1-5 embodiment, resilient tensioning means 128 comprise a pair of endless elastic bands, each secured at one end to one of the pins 130 and at its opposite end to one of the anchor pins 132.

Platform 120 is similarly supported relative to standards 114 by resilient tensioning means 138 in the nature of endless elastic bands or springs extending between pins 140 which depend from slide member 118 and an anchor pin 142 provided adjacent support arm 116 in each standard 114.

Anchor pin 142 is slidably receivable in an opening 144 which extends horizontally through each standard 114.

Slot 146 permits access to the shank of anchor pin 142 so that an end of resilient tensioning means 138 can be secured thereto.

By the interaction of the standards 114, side blocks or pads 122, top plate or pad 126 and support platform 120, and the strategic placement of resilient tensioning means 128 and 138 between the standards above the top of the speaker and below the platform upon which the speaker sits, the speaker is held firmly and virtually tremorless relative to the stand wherefore vibratory effects are minimized, with certain thereof being drained through the stand to the floor.

THE EMBODIMENT OF FIG. 11

Figure 11:
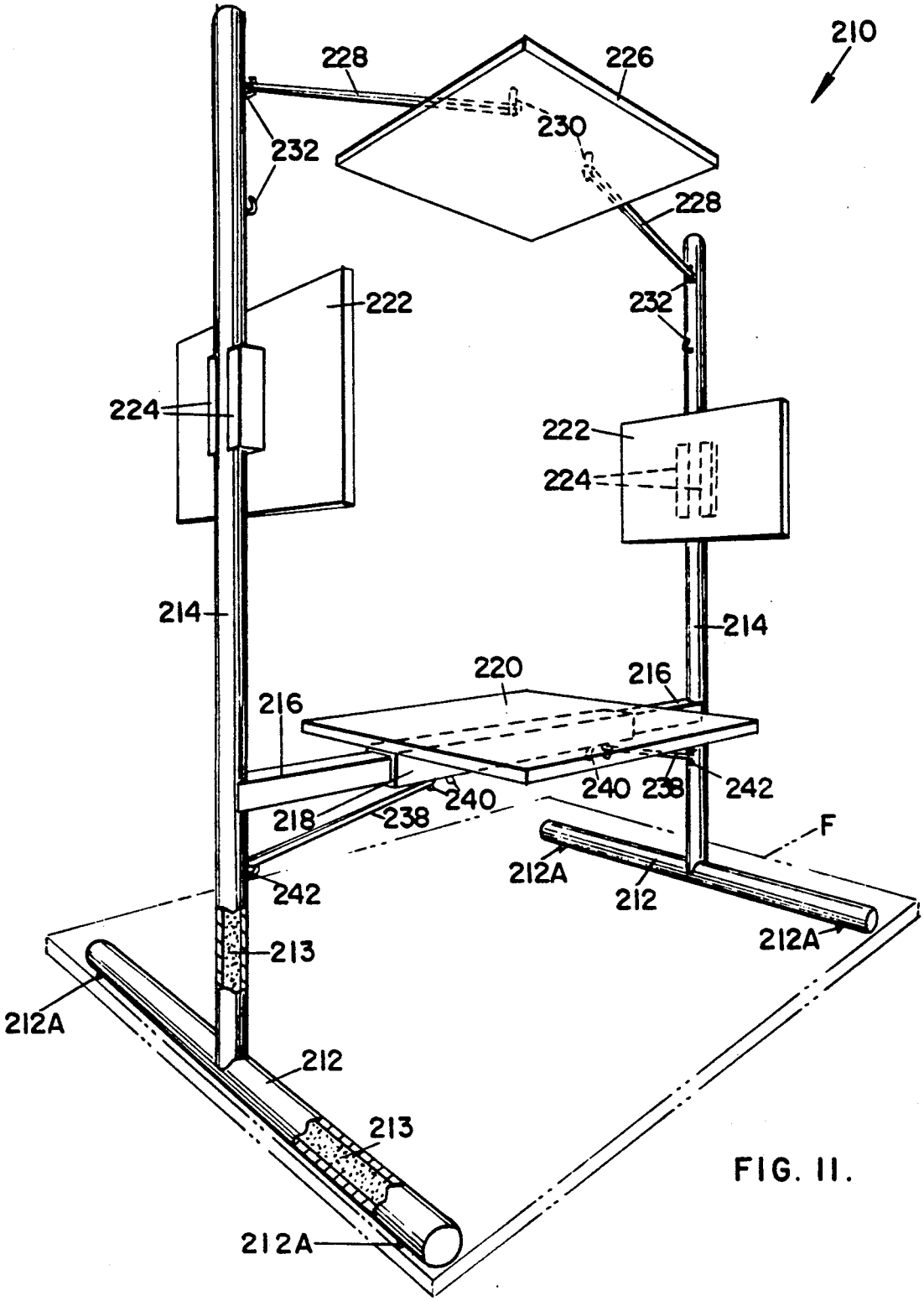
FIGS. 11–14 are front perspective views of second, third, fourth and fifth modified forms respectively of speaker support stands embodying the invention.

A second modified speaker support stand 210 is shown in FIG. 11.

Speaker support stand 210 includes a pair of elongated, tubular, horizontally-disposed legs 212 having small, pointed depending feet 212A adjacent each end thereof which support the legs upwardly of floor F. Legs 212 are disposed in spaced parallelism to each other.

A pair of elongated, tubular upright standards or posts 214 are fixed at their lower ends to legs 212 centrally of the latter and are also disposed in spaced parallelism to each other.

Standards 214 and legs 212 are filled with sand 213 or other damping material to effectively reduce vibrations.

A pair of generally rectangular horizontally-disposed, axially-aligned, inwardly-extending support arms 216 are each fixed at one end to the inner face of a standard 214 upwardly of legs 212.

The opposite, facing free ends of support arms 216 are sleeved by a U-shaped slide member 218 which has a horizontally-disposed rectangular support platform 220 fixed centrally to its upper face.

Arms 216 are slidable relative to slide member 218 and support platform 220 so that the spacing between standards 214 may be varied as desired.

A generally rectangular side block or pad 222 is provided on the inner face of each standard 214 upwardly of support platform 220, each side block 222 having a pair of spaced, parallel, vertically disposed rails 224 fixed to its rear face and lightly engageable with the walls of the adjacent standard 214, permitting the side blocks to be fixed in position at any desired height above the floor, while also permitting sliding movement of side blocks 222 relative to standards 214.

Side blocks 222 provide side support for a speaker, not shown, on support platform 220.

A generally rectangular top plate or pad 226 is positioned centrally between standards 214 upwardly of side blocks 222 and rests on the top of the speaker.

Top plate 226 is supported relative to standards 214 by resilient tensioning means 228 in the nature of elastic bands or springs which extend between upright pins 230 provided on the upper face of the top plate and anchor means 232 provided adjacent the upper end of each standard 214.

Platform 220 is similarly supported relative to standards 214 by resilient tensioning means 238 in the nature of endless elastic bands or springs extending between pins 240 which depend from slide member 218 and anchor means 242 provided adjacent support arm 216 on each standard 214.

By the interaction of the standards 214, side blocks or pads 272, top plate or pad 226 and support platform 220, and the strategic placement of resilient tensioning means 228 and 238 between the standards above the top of the speaker and below the platform upon which the speaker sits, the speaker is held firmly and virtually tremorless relative to the stand wherefore vibratory effects are minimized, with certain thereof being drained through the stand to the floor.

THE EMBODIMENT OF FIG. 12

Figure 12:
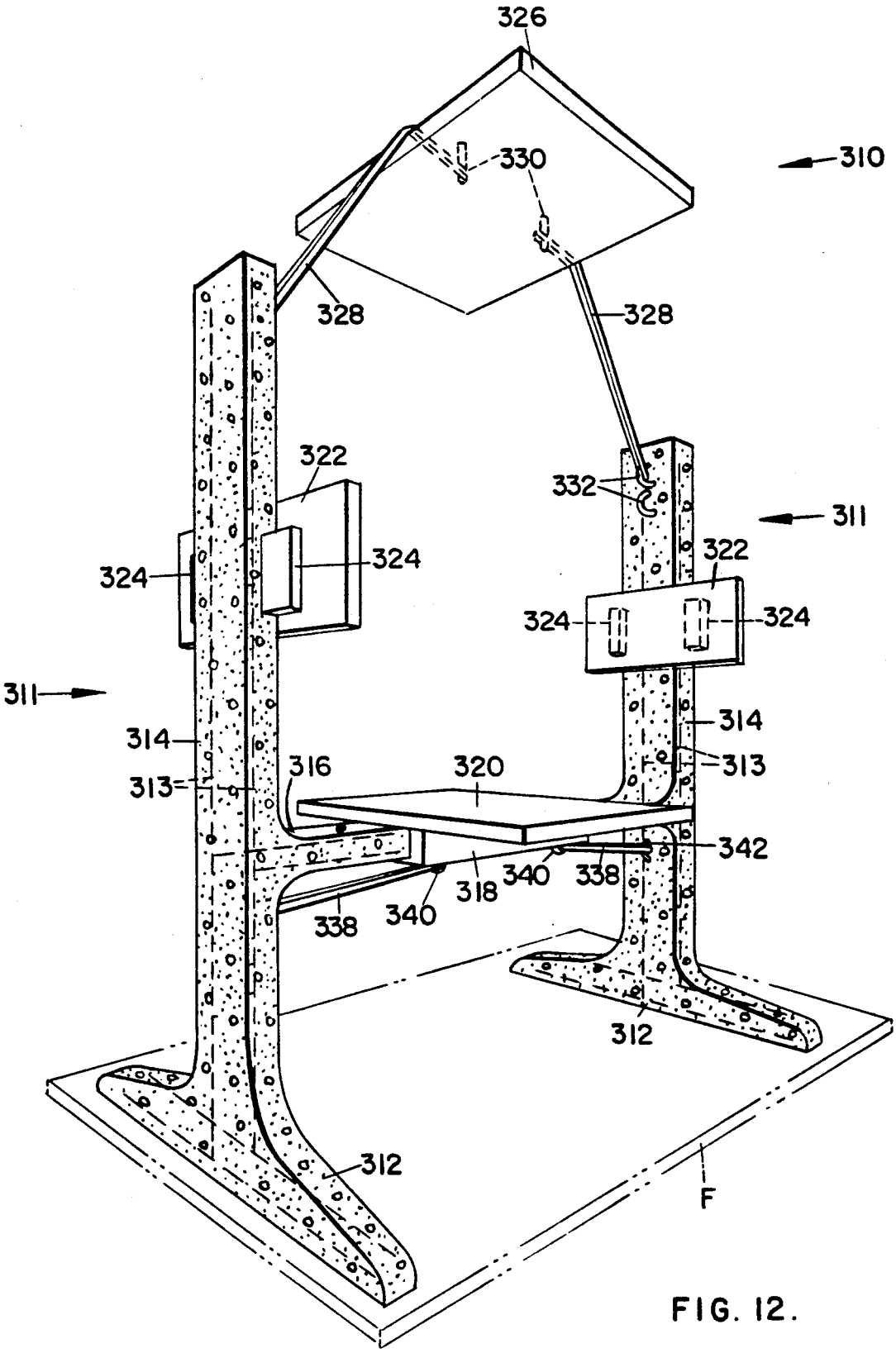

A third modified speaker support stand 310 is shown in FIG. 12.

Speaker support stand 310 includes a pair of side frame members 311 in the form of mold-cast concrete on a welded steel skeleton 313.

Side frame members 311 are disposed in spaced parallelism to each other and each includes a horizontally-disposed leg 312 which rest on floor F, an upright standard or post 314 formed integrally with and centrally of leg 312, and a horizontally-disposed support arm 316 formed integrally with and extending inwardly from standard or post 314 upwardly of leg 312.

Support arms 316 are axially aligned and their opposite, facing free ends are sleeved by a U-shaped slide member 318 which has a horizontally-disposed rectangular support platform 320 fixed centrally to its upper face.

Arms 316 are slidable relative to slide member 318 and support platform 320 so that the spacing between side frame members 311 may be varied as desired.

A generally rectangular side block or pad 322 is provided on the inner face of each standard 314 upwardly of support platform 320, each side block 322 having a pair of spaced, parallel, vertically disposed rails 324 fixed to its rear face and lightly engageable with the walls of the adjacent standard 314, permitting the side blocks to be fixed in position at any desired height above the floor, while also permitting sliding movement of side blocks 322 relative to standard 314.

Side blocks 322 provide side support for a speaker, not shown, on support platform 320.

A generally rectangular top plate or pad 326 is positioned centrally between side frame members 311 upwardly of side blocks 322 and rests on the top of the speaker.

Top plate 326 is supported relative to standards 314 by resilient tensioning means 328 in the nature of elastic bands or springs which extend between upright pins 330 provided on the upper face of the top plate and anchor means 332 provided adjacent the upper end of each standard 314.

Platform 320 is similarly supported relative to standards 314 by resilent tensioning means 338 in the nature of endless elastic bands or springs extending between pins 340 which depend from slide member 318 and anchor means 342 provided adjacent support arm 316 on each standard 314.

By the interaction of the standards 314, side blocks or pads 322, top plate or pad 326 and support platform 320, and the strategic placement of resilient tensioning means 328 and 338 between the standards above the top of the speaker and below the platform upon which the speaker sits, the speaker is held firmly and virtually tremorless relative to the stand wherefore vibratory effects are minimized, with certain thereof being drained through the stand to the floor.

THE EMBODIMENT OF FIG. 13

Figure 13:
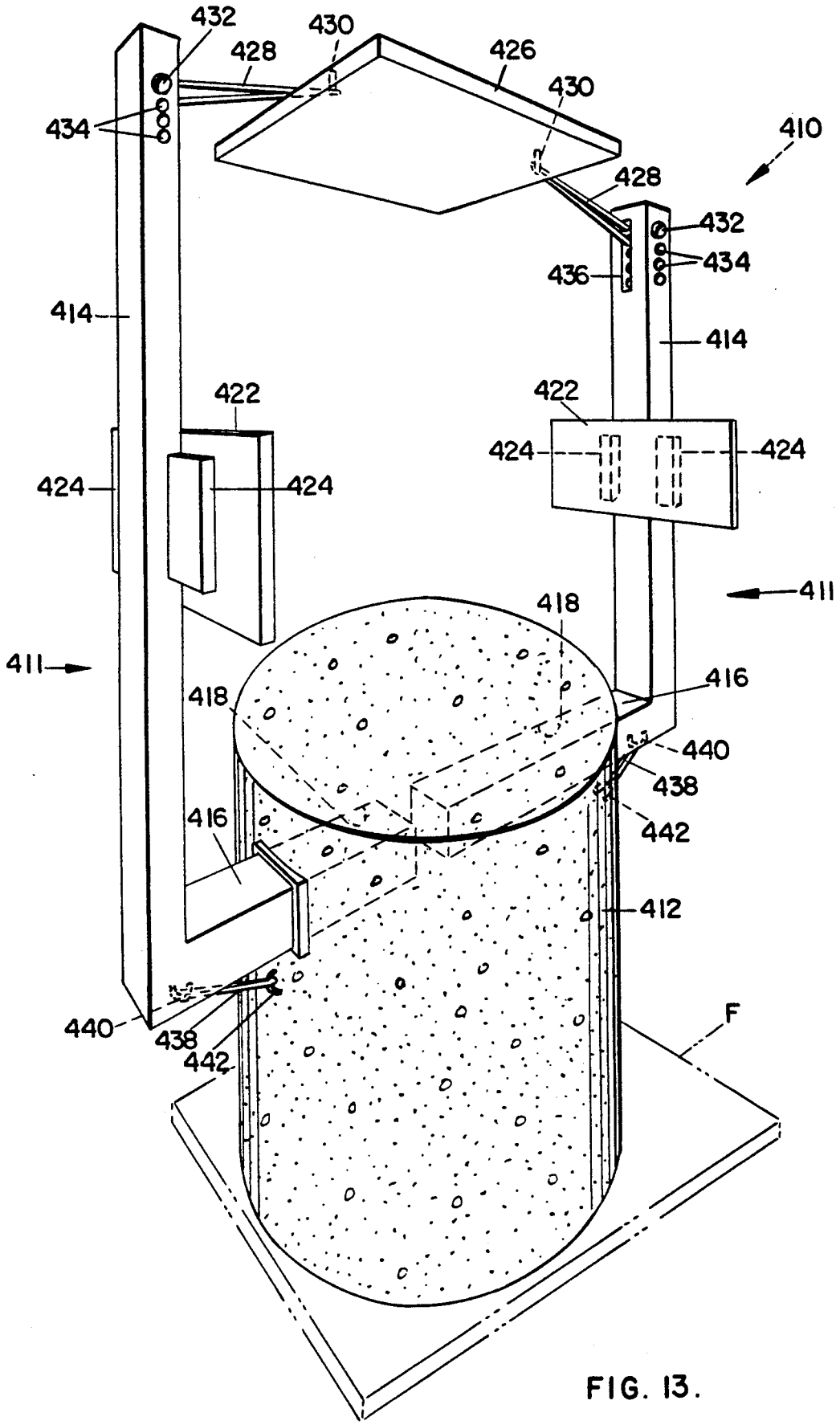

A fourth modified speaker support stand 410 is shown in FIG. 13.

Speaker support stand 410 includes an upstanding, cylindrical, precast concrete base 412 which rests on floor F.

A pair of spaced, L-shaped side frame members 411 are associated with base 412. Each includes an upright standard or post 414 and a horizontally-disposed support arm 416 formed integrally therewith and extending inwardly therefrom at a right angle thereto.

Support arms 416 are axially aligned and their opposite, facing free ends are slidably receivable in horizontally-disposed aligned openings 418 which extend inwardly into base 412 from the outer periphery thereof.

Arms 416 being slidable relative to base 412, the spacing between side frame members 411 may be varied as desired.

A generally rectangular side block or pad 422 is provided on the inner face of each standard 414 upwardly of base 412, each side block 422 having a pair of spaced, parallel, vertically disposed rails 424 fixed to its rear face and lightly engageable with the walls of the adjacent standard 414 permitting the side blocks to be fixed in position at any desired height above the floor, while also permitting sliding movement of side blocks 422 relative to standard 414.

Side blocks 422 provide side support for a speaker, not shown, supported by base 412.

A generally rectangular top plate or pad 426 is positioned centrally between side frame members 411 upwardly of side blocks 422 and rests on the top of the speaker.

Top plate 426 is supported relative to standards 414 by resilient tensioning means 428 in the nature of elastic bands or springs which extend between upright pins 430 provided on the upper face of the top plate and anchor pins 432 provided adjacent the upper end of each standard 414.

Anchor pins 432 are slidably receivable in any one of a series of vertically spaced openings 434 which extend horizontally through each standard 414.

The interior of each standard 414 is hollowed out in the area of openings 434 to provide a vertically-disposed slot 436 which extends inwardly into the standard to permit access to the shank of anchor pin 432 so that an end of resilient tensioning means 428 can be secured thereto.

The lower ends of side frame members 411 are similarly supported relative to base 412 by resilient tensioning means 438 in the nature of endless elastic bands or springs extending between anchor means 440 which depend from each support arm 416 and anchor means 442 provided on base 412.

By the interaction of side frame members 411, side blocks 422, top plate or pad 426 and support arms 416, and the strategic placement of resilient tensioning means 428 and 438 between the side frame members above the top of the speaker and below the support arms and base 412 upon which the speaker sits, the speaker is held firmly and virtually tremorless relative to the stand wherefore vibratory effects are minimized, with certain thereof being drained through the stand to the floor.

THE EMBODIMENT OF FIGS. 14–16

Figure 14:
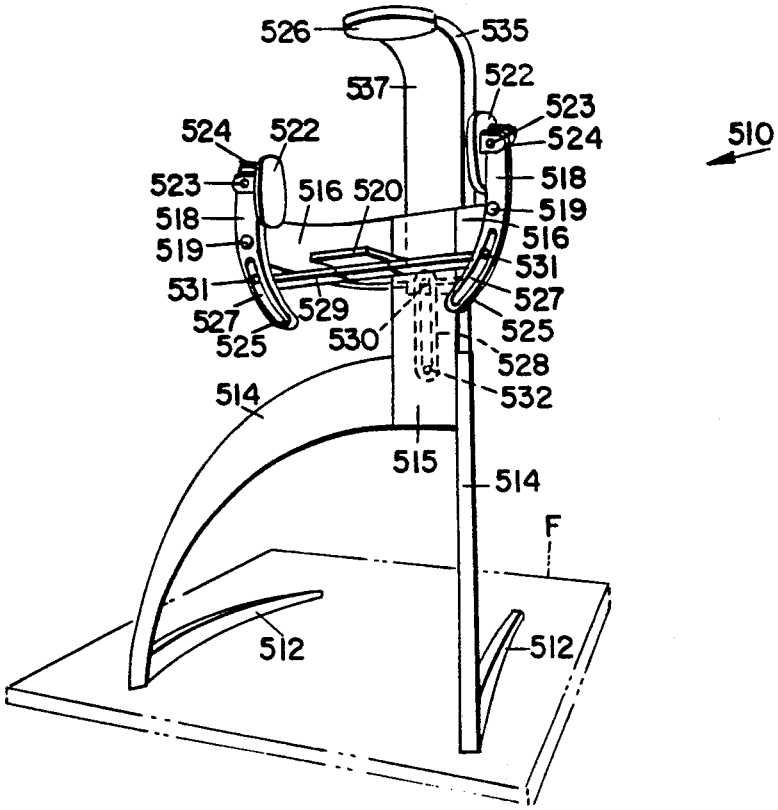
Figure 15:
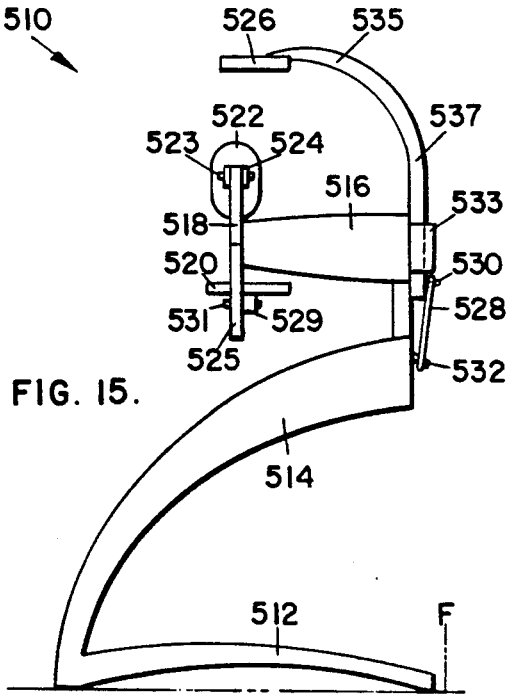
FIGS. 15 and 16 are side and front elevational views respectively of the speaker support stand of FIG. 14.
Figure 16:
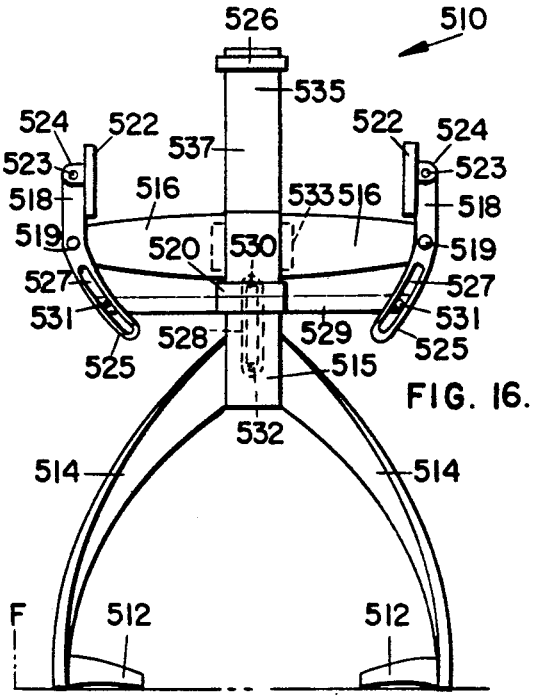

A fifth modified speaker support stand 510 is shown in FIGS. 14–16.

Speaker support stand 510 includes a pair of elongated horizontally-disposed legs 512 which rest on floor F and are disposed in spaced substantial parallelism to each other.

Legs 512 have a slightly convex bow, wherefore contact of their lower faces with the floor is obtained only at their forward and rearward ends.

A pair of elongated, generally upright standards or posts 514 are each fixed at their lower ends to the forward ends of legs 512 and curve upwardly, inwardly and rearwardly therefrom in converging manner. The pair of legs 512 and standards 514 each define a somewhat L-shape.

Standards or posts 514 are each fixed at their upper ends to the lower end of a flat, substantially rectangular, centrally-located upright first support column 515, one to each side face thereof.

A pair of axially-aligned, horizontally-disposed support arms 516 are each fixed at one end to the upper end of first support column 515, one to each side face thereof, and curve outwardly and forwardly therefrom.

A substantially-upright support link 518 is pivoted centrally of its length as at 519 to the forward free end of each support arm 516.

A substantially rectangular side block or pad 522 is provided on the inner face of each support link 518 and is pivoted to the upper end of the link by a pivot pin 523 which passes through a bifurcated bracket 524 fixed to the rear face of the side block.

Support links 518 each include an integral, depending inwardly curved extension 525 which has a vertically-disposed curved slot 527 extending therethrough.

A horizontally-disposed cross bar 529 extends between link extensions 525 below side blocks 522 rearwardly of support links 518 and has a pair of pins 531 which extend horizontally-forwardly therefrom one at each end thereof and through slots 527 for purposes to appear.

A flat rectangular, horizontally-disposed speaker support platform 520 is fixed centrally to the upper face of cross bar 529 and is disposed centrally between and below side blocks 522.

A flat, elongated, substantially rectangular centrally-located, upright second central support column 537 is disposed rearwardly of and in face-to-face contact with first central support column 515 and is slidably related to an upright bifurcated bracket 533 fixed to and extending rearwardly from the first central support column adjacent support arms 516.

Second central support column 537 includes an integral upwardly and inwardly-extending curved extension 535 which terminates in an inner free end which is disposed centrally between and above side plates 522 and has a flat, substantially rectangular top plate or pad 526 fixed to its lower face.

Top plate 526 is additionally supported relative to frame 510 by resilient tensioning means 528 in the nature of an elastic band or spring which extends between a pair of spaced pins 530 and 532 which project rearwardly from the rear faces of second central support column 537 and first central support column 515 respectively adjacent the lower ends of each.

In the embodiment of FIGS. 14–16, the weight of a speaker, not shown, placed on support platform 520 causes cross bar 529 to move downwardly moving pins 531 downwardly in slots 527 of support links 518 causing the links to pivot at 519 to effect a clamping force of side blocks 522 upon the speaker sides by lever action, while the resilient tensioning means 528 urges top plate 526 downwardly upon the speaker top.

By the interaction of the standards 514, side blocks or pads 522, top plate or pad 526, support platform 520, support links 518 and cross bar 529, and the strategic placement of the resilient tensioning means 528, a speaker placed on support platform 520 is held firmly and virtually tremorless relative to the stand wherefore vibratory effects are minimized, with certain thereof being drained through the stand to the floor.

I claim:

1. A vibration damping support system for a sound reproduction speaker within an enclosure defining bottom and top and opposite side walls and comprising:

a framework including a pair of upright parallel standards shiftable toward and away from each other, a horizontally-extending inwardly-facing support arm projecting from each standard toward the opposite arm, a base mounted on the pair of support arms and having an upper planar surface upon which the bottom wall of the enclosure may seat, a vertical side pad mounted on the inboard face of each standard for embracing a respective enclosure side wall as the standards are moved toward each other, an upper pad, an upper resilient tensioner strategically suspended between each standard and the upper pad for maintaining an downwardly bearing relationship of the upper pad upon the enclosure top wall, a lower resilient tensioner strategically suspended between each standard and the base below the upper planar surface thereof for maintaining a taut relationship of the enclosure bottom wall with the base, all adapted and arranged for minimizing vibratory effects in the achievement of speaker performance relatively free of spurious resonances.

2. A support stand according to claim 1, wherein the arms and side pads are selectively vertically positionable relative to the standards for accommodating enclosures of varying dimensions.

3. A support stand according to claim 1, wherein the resilient tensioners are elastic bands.

4. A support stand according to claim 1, wherein the resilient tensioners are springs.

5. A support stand according to claim 1, including vertically-disposed slots in each standard, a series of vertically spaced apertures opening into each slot, and locking pins insertable into the apertures for securing the resilient tensioner relative to the respective standard.

6. A support stand according to claim 1, including vertically-disposed slots in each standard, a series of vertically spaced apertures opening into each slot, bosses on the arms and side pads having apertures extending therethrough, the bosses being receivable in the slots of the standards, and locking pins insertable through the apertures in the standards and the bosses for releasably locking the arms and side pads in selected positions on the respective standards.

7. A support system according to claim 1, including, vertically-disposed slots in each standard, a series of vertically spaced apertures opening into the slots, and locking pins insertable into the apertures at varying positions for securing the resilient tensioners relative to a respective standard at appropriate heights.

8. A support system according to claim 1, including, vertically-disposed slots in each standard, a series of vertically spaced apertures opening into the slots, a boss on each support arm and each side pad, each boss being receivable in the slot of a respective standard, and a locking pin for releasably locking each support arm and each side pad in a selected position on the respective standard.

9. A vibration damping support system for an enclosure for a sound reproduction speaker within an enclosure defining bottom and top and opposite side walls, and comprising:

an upstanding precast concrete base having a pair of horizontally-extending axially-aligned recesses each on an opposite side of the base, the upper horizontally extending surface of the base defining a seat for the enclosure bottom wall, a pair of L shaped frame members each having a vertical long leg and an integral horizontal short leg extending in right angular relation from the lower terminus of the long leg, each short leg being adjustable receivable in a respective recess of the base, a vertical side pad mounted on the inboard face of each standard for hugging a respective enclosure side wall responsive to shifting movements of the frame members, an upper pad positionable upon the enclosure top wall, an upper resilient tensioner strategically disposed between each frame member and the upper pad for maintaining a downward pressing relationship between the upper pad and the enclosure top wall, a lower resilient tensioner strategically disposed between each frame member and the base for maintaining a bearing relationship between the base and the respective frame members, all adapted and arranged for minimizing vibratory effects in the attainment of speaker performance relatively free of spurious resonances.

10. A vibration damping support system for an enclosure accommodating a sound reproduction speaker, with the enclosure defining bottom and top and opposite side walls, and comprising:

a pair of generally upright standards each inclusive of a horizontally-extending foot and an integral post extending upwardly therefrom, the standards of the pair converging toward each other, a first support column having a lower terminus stationarily fixed to the posts of the pair and projecting vertically-upwardly therefrom, a pair of axially-aligned, horizontally-disposed support arms each fixed at its inboard end to the first support column and curving outwardly and forwardly therefrom, a substantially-upright support link pivoted centrally of its length to the outboard free end of a respective support arm, a vertically disposed side block pivotally mounted on the inner face of each support link, each support link including an integral lower curved extension having a through slot, a horizontally-disposed cross bar extending between the curved extensions of the pair and mounting a pin receivable through the through slot in the respective curved extension, a horizontally-extending base centrally mounted on the cross bar, a secondary support column adjustably-movable vertically relative to the first support column, a top plate fixed to the upper terminus of the secondary support column, a tensioning means between the first and secondary support columns, the weight of an enclosure and speaker on the base now driving the cross bar downwardly and the pivotable support links inwardly to effect a clamping force of the side blocks upon the respective enclosure side walls as the tensioning means urges the top plate downwardly into bearing relationship upon the enclosure top wall.

* * * * *